United States Patent [19]

Kaminski

[11] 4,062,283

[45] Dec. 13, 1977

[54] CAN CRUSHER

[76] Inventor: Stephen H. Kaminski, 215 West Elm Ave., Burbank, Calif. 91503

[21] Appl. No.: 679,982

[22] Filed: Apr. 26, 1976

[51] Int. Cl.[2] ..... B30B 15/32

[52] U.S. Cl. ..... 100/218; 100/293; 100/DIG. 2; 100/295

[58] Field of Search ..... 100/218, 293, 245, DIG. 2, 100/45, 283, 295; 241/99; 99/580, 581, 582, 583

[56] References Cited

U.S. PATENT DOCUMENTS

| | | | |
|---|---|---|---|
| 444,063 | 1/1891 | Emmons | 100/283 X |
| 647,490 | 4/1900 | Heath | 100/295 |
| 1,826,586 | 10/1931 | Williams | 100/295 |
| 2,563,379 | 8/1951 | Smith | 100/DIG. 2 |
| 2,603,271 | 7/1952 | Heymers | 100/DIG. 2 |
| 2,703,522 | 3/1955 | Smith | 100/283 |
| 3,009,414 | 11/1961 | Griemert | 100/DIG. 2 |
| 3,280,727 | 10/1966 | Jonas | 100/218 |

*Primary Examiner*—Billy J. Wilhite
*Attorney, Agent, or Firm*—Fulwider, Patton, Rieber, Lee & Utecht

[57] ABSTRACT

A manually operated, wall-mountable, beverage can crusher having a compact hollow housing of rectangular cross-section, a ram mounted for sliding movement within the housing, and an ejection spring secured to the rear wall of the housing and operative to urge crushed cans forwardly out of the housing as the ram is raised. The ram is raised and lowered by means of a lever arm pivoted to the top of the housing and connected to the top of the ram through a thrust link pivoted at both ends. The lever arm includes a cover plate which completes closure of the housing when the arm is lowered, and also includes a channel section which partly surrounds the thrust link for compactness of construction.

7 Claims, 5 Drawing Figures

CAN CRUSHER

BACKGROUND OF THE INVENTION

The present invention relates generally to can crushing devices and, more particularly, to manually operated can crushers for compressing lightweight cans of aluminum construction, such as are used for packaging various beverages.

A number of manually operated can crushing devices are to be found in the prior art. Some of these utilize a piston or ram which is moved toward a stationary plate by means of a hand-operated lever connected to the ram through some kind of mechanical linkage. A can is placed in position on the stationary plate and the lever is operated to lower the ram and crush the can. Typical of devices of this general type are those described in patents to Griemert (U.S. Pat. No. 3,009,414) and Smith (U.S. Pat. No. 2,563,379). The prior art devices, such as those of Griemert and Smith, typically employ a floor-mounted pedestal for the stationary plate, are usually relatively bulky and heavy in construction, and are relatively expensive to manufacture. Moreover, operation of can crushers of the prior art requires that the crushed cans be removed manually after raising the ram. Accordingly, there is still room for significant improvement in can crushing devices, and the present invention is directed to this end.

SUMMARY OF THE INVENTION

The present invention resides in a can crusher of the aforementioned general type, but having a lightweight, compact structure for wall mounting, and having means for automatically ejecting crushed cans. Briefly, and in general terms, the can crusher of the present invention comprises a hollow housing for wall mounting, having a baseplate for supporting a can to be crushed, a ram mounted for sliding movement within the housing, a lever arm pivotally mounted on the housing, a thrust link pivotally connected to the ram and to the lever arm, to transmit force to the ram on movement of the lever arm, and can ejection means operable as the ram is raised to eject the can from the housing.

In accordance with a further aspect of the invention, the lever arm includes a hollow channel section which in part surrounds the thrust link as the arm is lowered to a closed position, for increased compactness of construction. The lever arm also includes a cover plate which completes closure of the housing when the lever arm is lowered to its closed position.

More specifically, the housing is of rectangular cross-section, open at its front face, and the ram includes a pressure plate to which the lever arm is pivotally attached, and two integral guide plates which slidingly engage the sides of the housing. The lever arm is pivoted near the top of the housing for motion in a substantially vertical plane, and, when not in use, the ram and the lever arm will be held by their own weight in a lowered position.

The can ejection means in the presently preferred embodiment comprises a leaf spring attached to the inside of the rear wall of the housing. The leaf spring is held compressed against the rear wall by the ram in a lowered position, and, when the ram is raised after crushing a can, the spring is operative to urge the crushed can forwardly out of the housing.

Another feature of the invention is that the baseplate and the ram include at least one hole therethrough, to prevent any pressure build-up in the can as the ram is lowered, and thereby to facilitate manual operation of the device.

It will be appreciated from the foregoing that the present invention represents a signficant advance in the field of can crushers. In particular, its compact construction of relatively lightweight materials, and its inclusion of can ejection means, are features not to be found in can crushers available heretofore. Other aspects and advantages of the invention will become apparent from the following more detailed description taken in conjunction with the accompanying drawings.

DETAILED DESCRIPTION

Figure 1:
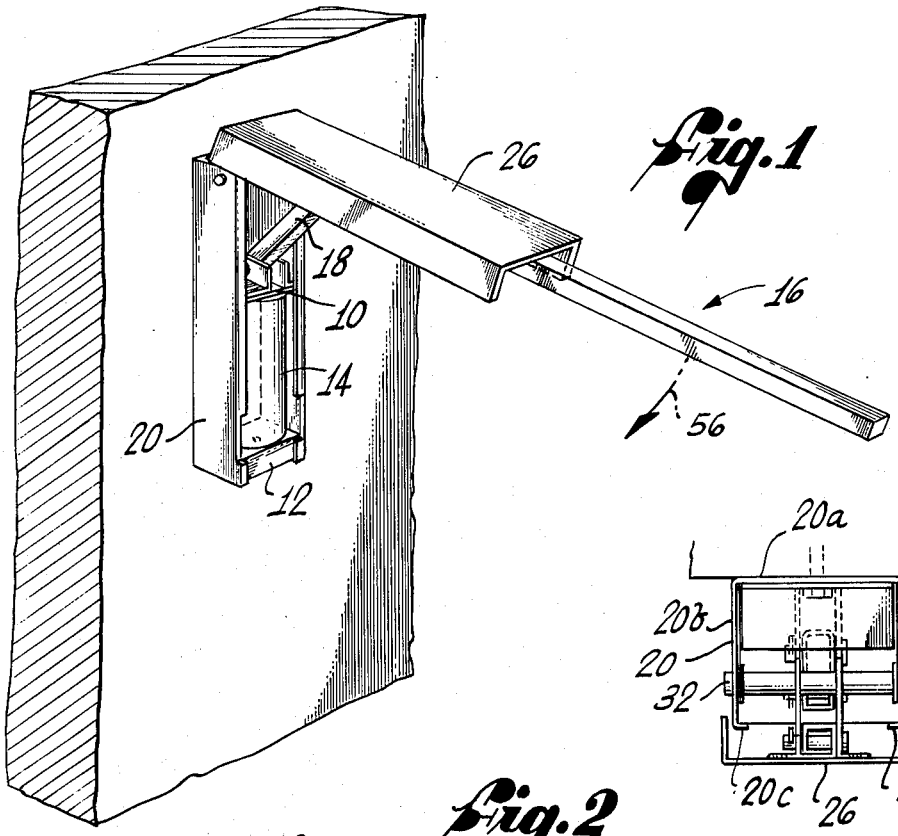
FIG. 1 is a perspective view of a can crusher embodying the features of the present invention, with the can crusher shown mounted on a wall and with the ram in a raised position.

As shown in the drawings for purposes of illustration, the present invention is principally concerned with a number of significant improvements in can crushers. In common with a number of can crushing devices of the prior art, the present invention includes a ram 10 which may be moved toward a baseplate 12, so that a can 14 can be crushed therebetween. The ram 10 is moved by means of a lever arm 16 and a connecting thrust link 18. Although there have been a number of can crushers conforming with this general description, the one to be described offers a number of significant advantages and improvements over devices available heretofore for the same purpose.

In accordance with the invention, the ram 10 is mounted for sliding movement within a hollow housing 20 which not only houses the device, but guides the ram in its movement, thereby providing an extremely compact and lightweight construction. Mounted inside the housing 20 is a leaf spring 22 which is compressed against the rear wall of the body as the ram 10 is lowered, but which springs outwardly as the ram is raised, automatically ejecting the crushed can 14.

Figure 4:
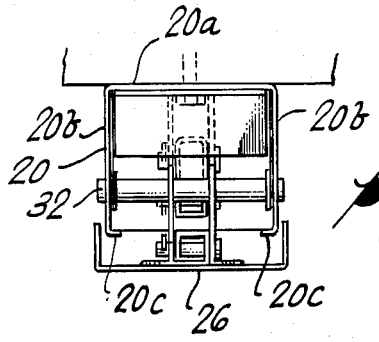
FIG. 4 is a plan view of the can crusher.
Figure 5:
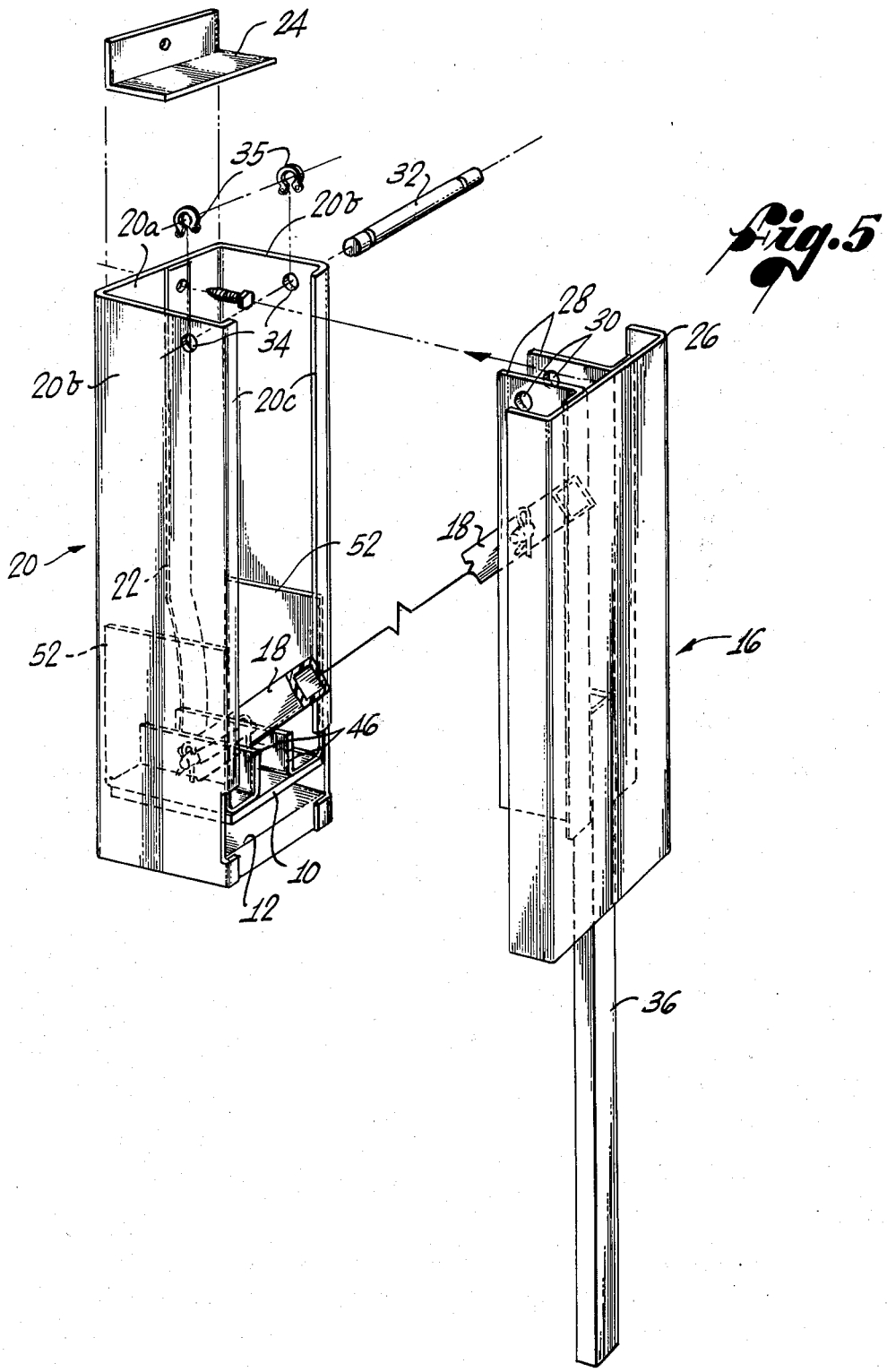
FIG. 5 is an exploded perspective view of the can crusher, with the ram shown in a lowered position.

More specifically, the housing 20 takes the form of a U-shaped channel member having a flat rear wall **20*a* and two flat sidewalls 20*b*, as best shown in FIGS. 4 and 5. The sidewalls 20*b* are, at the front edges thereof, bent inwardly to form a pair of retaining lips 20*c* to keep the ram 10 enclosed within the housing 20. The baseplate 12 is a relatively flat rectangular plate with right-angle bends at its front and rear edges to facilitate permanent mounting to the lower end of the housing 20. The rear wall 20*a* of the housing 20 is drilled to receive bolts 23 for purposes of wall mounting. For increased rigidity of the housing 20, one of the bolts 23 is also utilized to secure a right-angle bracket 24 which is sized to fit snugly between the sidewalls 20*b***.

Figure 2:
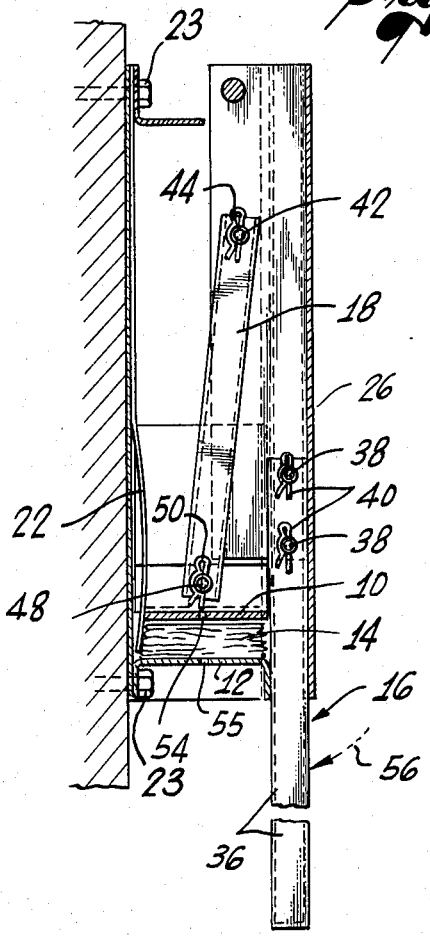
FIG. 2 is an enlarged side elevational view, partly in section, of the can crusher of FIG. 1, with the ram shown in a lowered position.
Figure 3:
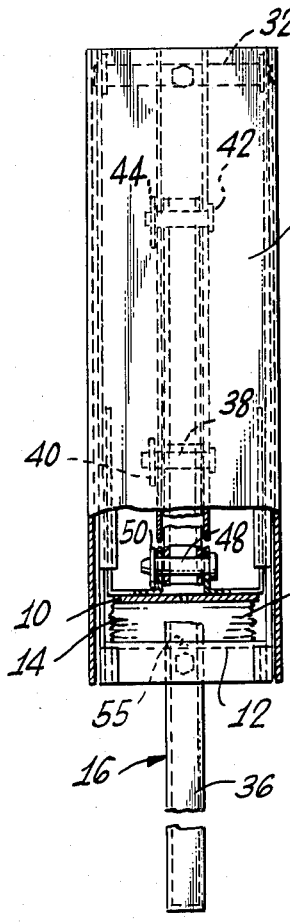
FIG. 3 is a front elevational view of the can crusher, partly in section and with the front cover partly broken away.

The lever arm 16 includes a front cover plate 26 which is sized to cover the open front of the housing 20 when the lever arm is in a lowered, vertically oriented position. Attached to the inside of the cover plate 26 are a pair of elongated members having an L-shaped cross-section, and arranged in parallel spaced relation so as to form a U-shaped channel together with the front cover 26. There is a pair of aligned holes 30 in the members 28, close to the top end thereof, and a pivot pin 32 is assembled through the holes and through corresponding aligned holes 34 in the sidewalls **20*b* of the housing 20, to mount the lever arm 16 pivotally to the housing. The pivot pin 32 is secured in position by spring clips 35 near its ends. The effective length of the lever arm 16 is increased by the addition of a rod 36 of rectangular cross-section, secured between the members 28 and against the rear face of the cover 26 by two flanged pins 38 extending through corresponding aligned holes in the members 28 and the rod 36, the pins being held in place by cotter pins 40, as best shown in FIGS. 2 and 3**.

The thrust link 18 is a straight rod also of rectangular cross-section, which may, as in the illustrative embodiment, be hollow for lightness of construction. The thrust link 18 is pivotally mounted by its upper end between the members 28, at a location toward the upper end of the lever arm 16 but significantly below the pivot holes 30. The link 18 is pivotally secured between the members 28 by means of another flanged pin 42, held in place by another cotter pin 44. The thrust link 18 is similarly pivotally attached at its lower end between two parallel, upwardly projecting plates 46 secured to the top of the ram 10. Again, a flanged pin 48 and a cotter pin 50 are used to effect the pivotal connection. In the illustrative embodiment of the invention, the upwardly projecting plates 46 are formed from two continuous sheets of metal which are bent outwardly to overlie portions of the ram 10, and are bent upwardly again to form a pair of guide plates 52 parallel with and closely fitting between the sidewalls **20*b* of the housing 20. The plates 46 are slightly wider, in a front-to-rear direction, than the ram 10, so that the leaf spring 22** can be positioned between the plates, thereby allowing free movement of the ram over the spring.

A hole 54 is provided in the ram 10, and another hole 55 in the baseplate 12. These are for venting purposes, and prevent any possible pressure build-up in the can as the ram 10 is lowered.

To operate the device of the invention, the lever arm 16 is first raised, lifting the front cover 26 from the housing 20, and raising the ram 10 sufficiently to insert the can 14 to be crushed. As the can 14 is inserted, the leaf spring 22 is compressed toward the rear wall **20*a* of the housing, and a rearward force must be maintained on the can to prevent its ejection before a crushing force is applied. Then, the lever arm 16 is lowered, as shown by the arrows 56 in FIGS. 1 and 2, thereby applying downward force to the ram 10 through the thrust link 18, and crushing the can against the baseplate 12, as shown in FIG. 2. The lever arm 16 is then raised again, allowing the leaf spring 22 to eject the crushed can 14 from the housing 20. The lever arm 16** may then be lowered or allowed to fall to the closed position.

The housing 20, baseplate 12, ram 10, guideplates 52, bracket 24, front cover 26, and L-section members 28 can all be conveniently fabricated from sheet metal. The rod 36 and thrust link 18 are of easily obtainable rectangular tube stock, and the other elements are off-the-shelf items. Consequently, the entire device is relatively inexpensive to manufacture and assemble, and the hollow, sheet-metal construction is lightweight, yet rigid.

It will be appreciated from the foregoing that the present invention provides significant advantages over similar devices for the same general purpose shown in the prior art. In particular, the device of the present invention is of lightweight and compact construction, and can be manufactured relatively inexpensively. In addition, the inclusion of the leaf spring 22 to eject the cans automatically, and the provision of venting holes in the ram and baseplate, facilitate convenient manual operation of the can crusher. Although one preferred embodiment of the invention has been described in detail for purposes of illustration, it will be appreciated that various modifications may be made without departing from the spirit and scope of the invention. Accordingly, the invention is not to be limited except as by the appended claims.

I claim:

1. A manually operated beverage can crusher, comprising:

an open-faced hollow rectangular housing mountable against a wall, and having a baseplate for supporting a can to be crushed;

a ram mounted for sliding movement within said housing, including a pressure plate and two guide plates integral therewith and substantially perpendicular thereto for slidingly engaging interior walls of said housing;

a lever arm mounted by one end to an upper portion of said housing;

a thrust link pivotally connected to said pressure plate and pivotally connected to said lever arm at a point substantially below its point of pivotal mounting to said housing; and can ejection means including a leaf spring secured interiorly to said housing and operable to urge the can outwardly from said housing as said ram and said lever arm are raised.

2. A beverage can crusher as set forth in claim 1, wherein said baseplate and said pressure plate are perforated to vent the can to be crushed therebetween.

3. A beverage can crusher as set forth in claim 1, wherein said lever arm includes a front cover plate for completing closure of said housing when said lever arm is lowered to its closed position.

4. A can crusher comprising:

a hollow wall-mountable housing, including a baseplate for supporting a can to be crushed;

a movable ram for crushing the can against said baseplate, mounted for sliding movement within said housing;

a lever arm pivotally mounted on said housing;

a thrust link pivotally connected to said ram and to said lever arm to transmit force to said ram on movement of said lever arm; and can ejection means operable as said ram is moved away from said baseplate, to eject the can from said housing;

wherein said lever arm is in part of open channel construction and is sized to partly enclose said thrust link as said lever arm is lowered to a closed position, thereby providing a compact overall structure.

5. A can crusher comprising:

a hollow wall-mountable housing, including a baseplate for supporting a can to be crushed;

a movable ram for crushing the can against said baseplate, mounted for sliding movement within said housing;

a lever arm pivotally mounted on said housing, and including a front cover plate which completes closure of said housing when said lever arm is moved to a closed position;

a thrust link pivotally connected to said ram and to said lever arm to transmit force to said ram on movement of said lever arm; and can ejection means operable as said ram is moved away from said baseplate, to eject the can from said housing.

6. A can crusher as set forth in claim 5, wherein said lever arm is pivoted at its upper end, and will fall to its closed position under its own weight.

7. A can crusher comprising:

a hollow wall-mountable housing, including a baseplate for supporting a can to be crushed;

a movable ram for crushing the can against said baseplate, mounted for sliding movement within said housing;

a lever arm pivotally mounted on said housing;

a thrust link pivotally connected to said ram and to said lever arm to transmit force to said ram on movement of said lever arm; and can ejection means operable as said ram is moved away from said baseplate, to eject the can from said housing, said can ejection means including a leaf spring secured to a rear wall of said housing, said leaf spring being operative to urge the crushed can from said housing as said ram is moved away from said baseplate.

* * * * *